US010260515B2

(12) United States Patent
Sakaguchi

(10) Patent No.: US 10,260,515 B2
(45) Date of Patent: Apr. 16, 2019

(54) STATOR COMPONENT OF VACUUM PUMP

(71) Applicant: Edwards Japan Limited, Yachiyo-shi, Chiba (JP)

(72) Inventor: Yoshiyuki Sakaguchi, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 342 days.

(21) Appl. No.: 14/917,772

(22) PCT Filed: Jun. 6, 2014

(86) PCT No.: PCT/JP2014/065157
§ 371 (c)(1),
(2) Date: Mar. 9, 2016

(87) PCT Pub. No.: WO2015/040898
PCT Pub. Date: Mar. 26, 2015

(65) Prior Publication Data

US 2016/0222974 A1 Aug. 4, 2016

(30) Foreign Application Priority Data

Sep. 17, 2013 (JP) ..... 2013-191485

(51) Int. Cl.
*F04D 19/04* (2006.01)
*F04D 29/02* (2006.01)
(Continued)

(52) U.S. Cl.
CPC ..... *F04D 29/023* (2013.01); *F04D 17/168* (2013.01); *F04D 19/042* (2013.01);
(Continued)

(58) Field of Classification Search
CPC .... F04D 29/023; F04D 17/168; F04D 19/042; F04D 29/4206; F04D 29/444
See application file for complete search history.

(56) References Cited

U.S. PATENT DOCUMENTS 6,095,754 A * 8/2000 Ono ..... F04D 19/04 416/224
6,926,493 B1 * 8/2005 Miyamoto ..... F04D 19/042 415/143
(Continued)

FOREIGN PATENT DOCUMENTS

JP H07313931 A 12/1995
JP H1162879 A * 3/1999
(Continued)

OTHER PUBLICATIONS

PCT International Search Report dated Aug. 19, 2014 for corresponding PCT Application No. PCT/JP2014/065157.
(Continued)

*Primary Examiner* — Justin D Seabe
*Assistant Examiner* — Sabbir Hasan
(74) *Attorney, Agent, or Firm* — Westman, Champlin & Koehler, P.A.; Theodore M. Magee

(57) ABSTRACT

The present invention provides a stator component of a vacuum pump, which is suitable for reducing the fracture energy (energy of fracture that occurs when a rotor of the pump is damaged during its rotation) and the size of the pump, and also provides a vacuum pump having this stator component. In the vacuum pump, a spacer or of a thread groove pump stator, which is a stator component forms a gap satisfying the following <<condition>> between an outer circumferential surface of each of housed in a pump case of the vacuum pump, and an inner circumferential surface of the pump case, with the stator component being housed in the pump case. <<Condition>> $2d/D \leq \varepsilon_{max}$, where D is the outer diameter of the stator component (spacer or thread groove pump stator), d is the width of the gap, and $\varepsilon_{max}$ is the breaking elongation of the stator component.

12 Claims, 3 Drawing Sheets

(51) Int. Cl.

| | |
|---|---|
| ***F04D 29/52*** | (2006.01) |
| ***F04D 29/64*** | (2006.01) |
| ***F04D 17/16*** | (2006.01) |
| ***F04D 25/06*** | (2006.01) |
| ***F04D 29/28*** | (2006.01) |
| ***F04D 29/42*** | (2006.01) |
| ***F04D 29/44*** | (2006.01) |

(52) U.S. Cl.
CPC ..... *F04D 25/06* (2013.01); *F04D 29/28* (2013.01); *F04D 29/4206* (2013.01); *F04D 29/444* (2013.01); *F04D 29/522* (2013.01); *F04D 29/644* (2013.01); *F05D 2230/21* (2013.01); *F05D 2300/518* (2013.01)

(56) References Cited

U.S. PATENT DOCUMENTS 8,591,204 B2 * 11/2013 Yamaguchi ..... F04D 19/042 417/423.4
2011/0014073 A1 1/2011 Yamaguchi

FOREIGN PATENT DOCUMENTS

| | | | |
|---|---|---|---|
| JP | H1162879 | A | 3/1999 |
| JP | 2001082379 | A | 3/2001 |
| JP | 2002349472 | A | 12/2002 |
| JP | 2003065282 | A | 3/2003 |
| JP | 2003148380 | A | 5/2003 |
| JP | 2003286991 | A | 10/2003 |
| JP | 2007319867 | A | 12/2007 |
| JP | 2008157257 | A | 7/2008 |

OTHER PUBLICATIONS

Communication dated Apr. 13, 2017 and Supplementary European Search Report dated Apr. 7, 2017 for corresponding European Application No. EP14846575.

* cited by examiner $2d / D \leq \varepsilon_{max}$

STATOR COMPONENT OF VACUUM PUMP

CROSS-REFERENCE TO RELATED APPLICATION

This application is a Section 371 National Stage Application of International Application No. PCT/JP2014/065157, filed Jun. 6, 2014, which is incorporated by reference in its entirety and published as WO 2015/040898 on Mar. 26, 2015 and which claims priority of Japanese Application No. 2013-191485, filed Sep. 17, 2013.

BACKGROUND OF THE INVENTION

1. Field of the Invention

The present invention relates to an annular stator component housed in a pump case as a component of a vacuum pump that exhausts gas taken in by rotor rotation in the pump case.

2. Description of the Related Art

A turbo-molecular pump described in Japanese Patent Application No. 4197819, for example, has conventionally been known as a vacuum pump that exhausts gas taken in by rotor rotation in a pump case of the pump. The turbo-molecular pump of Japanese Patent Application No. 4197819 is configured to take in gas from an inlet port (in the vicinity of a flange 14a) by rotating the rotor (R) and exhausts the gas from an outlet port (15a) (see paragraph 0024 of Japanese Patent Application No. 4197819).

According to the turbo-molecular pump of Japanese Patent Application No. 4197819, an internal casing (142) is provided inside the pump casing (14), the rotor (R) is housed in the internal casing (142), and a gap (T) is formed between the internal casing (142) and the pump casing (14) as a way to absorb in the internal casing (142) the energy of fracture that occurs when the rotor (R) is damaged during its rotation (referred to as "fracture energy," hereinafter). Such a configuration enables the fracture energy to deform the internal casing (142) and enables absorption of the fracture energy by means of the deformation.

However, in the turbo-molecular pump described in Japanese Patent Application No. 4197819, although the fracture energy from the rotor (R) is converted into the energy for deforming the internal casing (142) to absorb the fracture energy, the gap (T) is not set in view of the elongation of the material configuring the internal casing (142). For this reason, sometimes the fracture energy cannot be absorbed sufficiently in spite of the gap (T). In terms of conserving space, providing the gap (T) without taking the elongation of the material into consideration is one of the factors interfering with the attempt to reduce the size of the turbo-molecular pump.

The foregoing reference numerals in the parentheses are used in Japanese Patent Application No. 4197819.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

The present invention was contrived in view of the foregoing problems, and an object thereof is to provide a stator component of a vacuum pump, which is suitable for reducing the fracture energy (energy of fracture that occurs when a rotor of the pump is damaged during its rotation), and a vacuum pump having this stator component.

In order to achieve the foregoing object, the present invention provides a stator component of a vacuum pump, which is an annular stator component housed in a pump case as a component of the vacuum pump that exhausts gas taken in by rotation of a rotor in the pump case, wherein the stator component forms a gap which satisfies the following <<condition>> between an outer circumferential surface of the stator component and an inner circumferential surface of the pump case, with the stator component being housed in the pump case:

$$2d/D \leq \varepsilon_{max} \qquad \text{<<Condition>>}$$

D: Outer diameter of the stator component d: Width of the gap $\varepsilon_{max}$: Breaking elongation of the stator component.

In the present invention described above, the stator component may be produced by a casting.

In the present invention described above, the stator component may be a metal mold casting produced by casting with a metal mold.

In the present invention described above, the stator component may be a sand casting treated with heat processing after being produced by casting by sand mold.

In the present invention described above, the stator component may be added with an additive when the stator component is produced by the casting, to make the breaking elongation equal to that of a solid material.

In the present invention described above, the stator component may be made of aluminum alloy.

The present invention is also a vacuum pump having the stator component.

In the present invention, the annular stator component housed in the pump case is specifically configured to form a gap between the outer circumferential surface thereof and the inner circumferential surface of the pump case while being housed in the pump case, the gap satisfying the <<condition>> described above. According to this configuration, even when the stator component is fully, extensionally deformed due to the fracture energy, that is, even when the stator component is extensionally deformed to approximately the same extent as the breaking elongation $\varepsilon_{max}$ thereof, the extensionally deformed stator component does not come into contact with the inner surface of the pump case or slightly comes into contact therewith, effectively preventing the phenomenon where the fracture energy is transmitted to the pump case through the extensionally deformed stator component. The present invention, therefore, can provide a stator component of a vacuum pump, which is not only capable of absorbing sufficient fracture energy but also suitable for reducing the fracture energy while reducing the size of the pump case, as well as a vacuum pump provided with this stator component.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Best mode for implementing the present invention is described hereinafter in detail with reference to the accompanying drawings.

Figure 1:
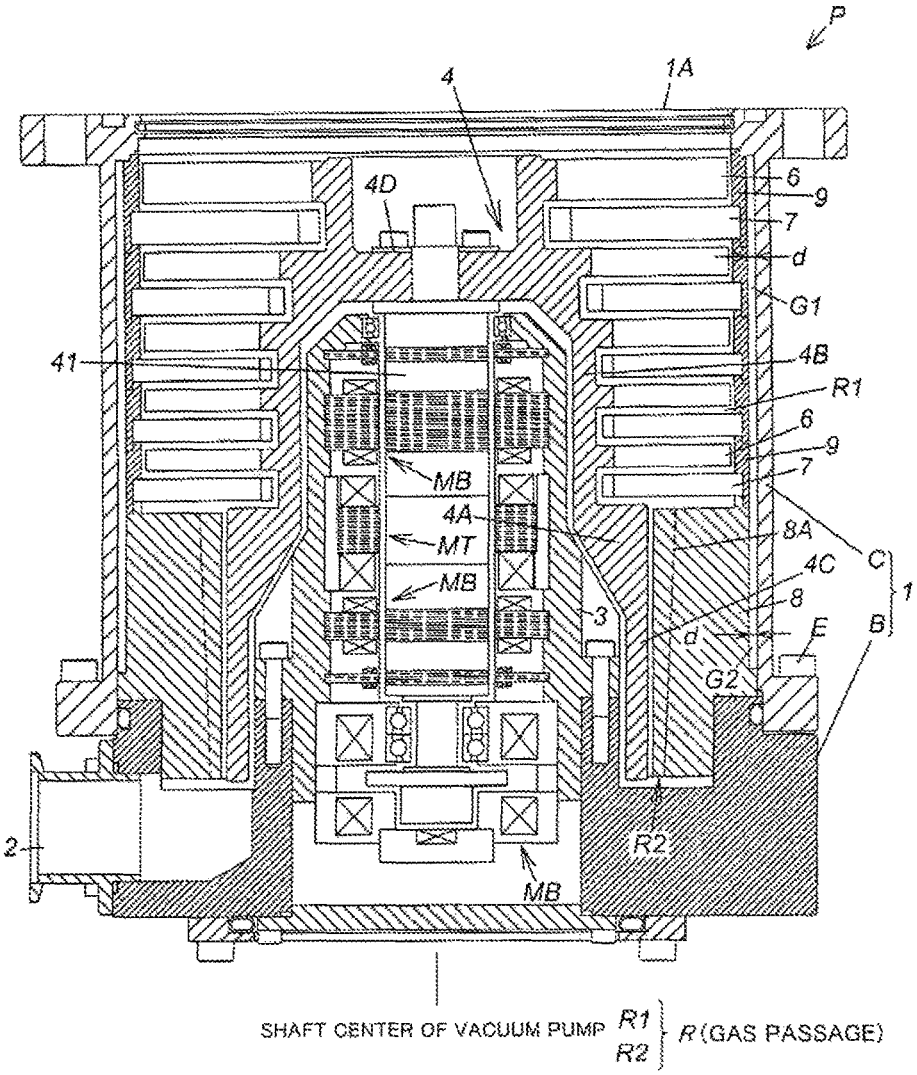
FIG. 1 is a cross-sectional diagram of a vacuum pump that has a stator component for a vacuum pump according to the present invention.
Figure 2A:
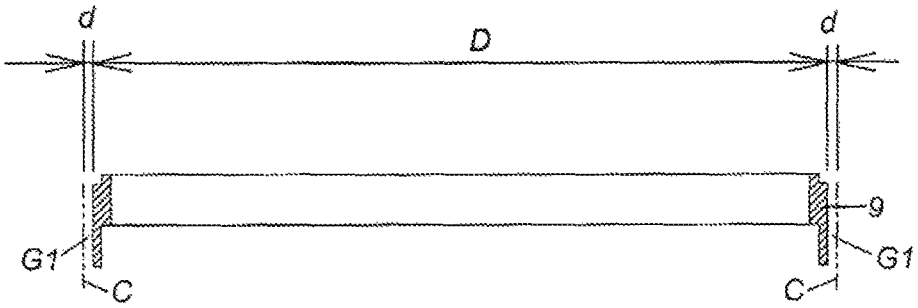
FIG. 2A is a cross-sectional diagram of a spacer (half of it) configuring the vacuum pump of FIG. 1.
Figure 2B:
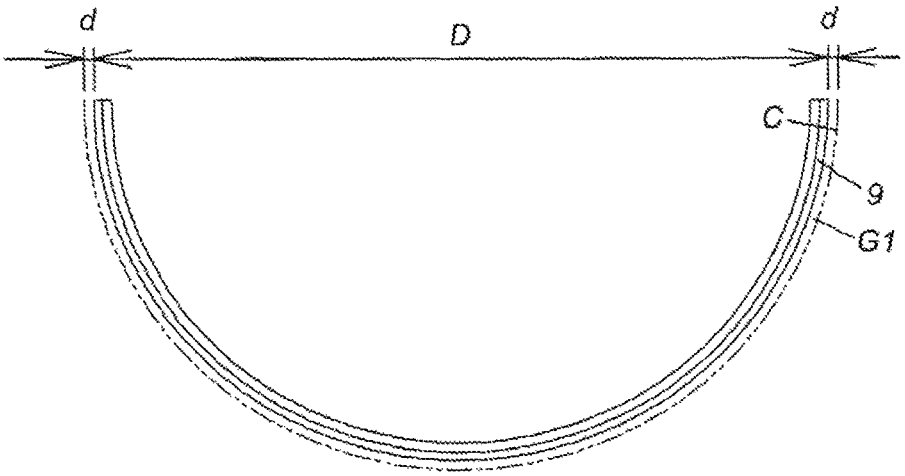
FIG. 2B is a plan view of the spacer.

FIG. 1 is a cross-sectional diagram of a vacuum pump provided with a vacuum pump stator component according to the present invention. FIG. 2A is a cross-sectional diagram of a spacer (half of it) configuring the vacuum pump of FIG. 1 and FIG. 2B a plan view of the spacer.

A vacuum pump P shown in FIG. 1 is used as, for example, gas outlet means or the like of a process chamber or other sealed chamber of a semiconductor manufacturing apparatus, a flat panel display manufacturing apparatus, and a solar panel manufacturing apparatus.

An outer case 1 of the vacuum pump P shown in FIG. 1 is shaped into a cylinder with a bottom by integrally coupling a cylindrical pump case C and a pump base B in a cylindrical axial direction thereof using tightening means E.

The upper end side of the pump case C (upper side of the page space in FIG. 1) is opened as a gas inlet port 1A, and the pump base B is provided with a gas outlet port 2. The gas inlet port 1A is connected to, for example, a high-vacuum closed chamber, not shown, such as a process chamber of a semiconductor manufacturing apparatus. The gas outlet port 2 is communicated with and connected to an auxiliary pump, not shown.

A cylindrical stator column 3 is provided at a central portion inside the pump case C. The stator column 3 is provided upright on the pump base B, and a rotor 4 is provided outside the stator column 3. A magnetic bearing MB for supporting the rotor 4, a drive motor MT for rotary driving the rotor 4, and various other electrical components are embedded in the stator column 3. The magnetic bearing MB and the drive motor MT are well known; thus, the detailed descriptions of the specific configurations of these components are omitted.

The rotor 4 is disposed rotatably on the pump base B and surrounded by the pump base B and the pump case C. The rotor 4, in a cylindrical shape surrounding the outer circumference of the stator column 3, couples two cylinders having different diameters (a first cylinder 4B and a second cylinder 4C) in a cylindrical axial direction thereof using a coupling portion 4A, and closes the upper end side of the first cylinder 4B with an end member 4D.

A rotating shaft 41 is installed inside the rotor 4, wherein the rotating shaft 41 is supported by the magnetic bearing MB embedded in the stator column 3 and rotary driven by the drive motor MT embedded in the stator column 3. Therefore, the rotor 4 is supported in such a manner as to be rotatable and rotary driven about its shaft center (the rotating shaft 41). In this configuration, the rotating shaft 41 and the magnetic bearing MB and drive motor MT embedded in the stator column 3 function as supporting and driving means for supporting and driving the rotor 4. On the basis of a configuration different from this configuration, the rotor 4 may be rotatably supported and rotary driven about its shaft center.

The vacuum pump P shown in FIG. 1 has a gas passage R as a way to guide to the outlet port 2 the gas that is taken in from the inlet port 1A by the rotation of the rotor 4 in the pump case C and to exhaust the gas through the outlet port 2 to the outside.

According to an embodiment of the gas passage R, of the entire gas passage R in the vacuum pump P shown in FIG. 1, a first-half inlet-side gas passage R1 (upstream of the coupling portion 4A of the rotor 4) is configured with a plurality of rotary blades 6 arranged on the outer circumferential surface of the rotor 4 and a plurality of stator blades 7 fixed to the inner circumferential surface of the pump case C with spacers 9 therebetween, while a last-half outlet-side gas passage R2 (downstream of the coupling portion 4A of the rotor 4) is configured as a passage in the form of a thread groove by the outer circumferential surface of the rotor 4 (specifically, the outer circumferential surface of the second cylinder 4C) and a thread groove pump stator 8 facing the outer circumferential surface of the rotor 4.

The configuration of the inlet-side gas passage R1 is described in more detail. The plurality of rotary blades 6 configuring the inlet-side gas passage R1 in the vacuum pump P shown in FIG. 1 are arranged radially around a pump shaft center such as a rotation center of the rotor 4. On the other hand, the stator blades 7 configuring the inlet-side gas passage R1 are positioned in the pump radial direction and pump axial direction and arranged fixedly on the inner circumferential side of the pump case C with the spacers 9 therebetween and also radially around the pump shaft center.

In the vacuum pump P shown in FIG. 1, the rotary blades 6 and stator blades 7 that are arranged radially as described above are arranged into alternate layers along the pump shaft center, thereby configuring the inlet-side gas passage R1.

In the inlet-side gas passage R1 having the foregoing configuration, the activation of the drive motor MT causes the rotor 4 and the plurality of rotary blades 6 to rotate integrally at high speed, causing the rotary blades 6 to apply a downward momentum to the gas molecules injected from the gas inlet port 1A. The gas molecules with this downward momentum are sent toward the subsequent layer of rotary blades by the fixed blades 7. As a result of repeating this application of a momentum to the gas molecules and the operation of sending the gas molecules throughout the multiple layers of blades, the gas molecules at the gas inlet port side are exhausted through the inlet-side gas passage R1 in such a manner as to be carried sequentially in the direction of the outlet-side gas passage R2.

Next, the configuration of the outlet-side gas passage R2 is described in more detail. In the vacuum pump P shown in FIG. 1, the thread groove pump stator 8 configuring the outlet-side gas passage R2 is an annular stator component surrounding the downstream-side outer circumferential surface of the rotor 4 (specifically, the outer circumferential surface of the second cylinder 4C; the same hereinafter), and is disposed in such a manner that the inner circumferential surface thereof faces the downstream-side outer circumferential surface of the rotor 4 (specifically, the outer circumferential surface of the second cylinder 4C) with a predetermined gap therebetween.

A thread groove 8A is formed in an inner circumferential portion of this thread groove pump stator 8 and shaped like a tapered cone such that the diameter of the thread groove 8A decreases with increasing depth of the thread groove 8A. The thread groove 8A is also provided in a spiral shape from an upper end of the thread groove pump stator 8 to a lower end thereof.

In the vacuum pump P shown in FIG. 1, the downstream-side outer circumferential surface of the rotor 4 and the thread groove pump stator 8 with the thread groove 8A face each other, configuring the outlet-side gas passage R2 as a gas passage in the shape of a thread groove. According to an embodiment different from this embodiment, a configuration may be employed in which, for example, although not shown, the outlet-side gas passage R2 is configured by providing the thread groove 8A in the downstream-side outer circumferential surface of the rotor 4.

In the outlet-side gas passage R2 having the foregoing configuration, when the rotor 4 is rotated by the activation of the drive motor MT, the gas flows in from the inlet-side gas passage R1, and due to the drag effect between the thread groove 8A and the downstream-side outer circumferential surface of the rotor 4, this gas is carried and exhausted while being compressed from a transitional flow to a viscous flow.

<<Means for Absorbing Fracture Energy>>

The spacers 9 are each an annular stator component housed in the pump case C as a component of the vacuum pump P (see FIGS. 2A and 2B) and are stacked in layers on an upper end portion of the thread groove pump stator 8, as show in FIG. 1. Outer circumferential ends of the stator blades 7 are inserted between the stacked spacers 9, fixedly positioning the stator blades 7 in the pump case C.

The spacers 9, which are configured to fixedly position the stator blades 7 as described above, also function as the means for absorbing the fracture energy. In other words, in the vacuum pump P shown in FIG. 1, a gap G1 satisfying the following <<condition 1>> is formed between the outer circumferential surfaces of the spacers 9 housed in the pump case C and the inner circumferential surface of the pump case C.

$$2d/D \leq \varepsilon_{max} \qquad \text{<<Condition 1>>}$$

D: Outer diameter of the stator components (spacers 9)

2d: Width of the gap G1

$\varepsilon_{max}$: Breaking elongation of the stator components (spacers 9) (see FIG. 3)

Incidentally, as with the spacers 9, the thread groove pump stator 8 is an annular stator component that is housed in the pump case C as a component of the vacuum pump P. In the vacuum pump P shown in FIG. 1, a gap G2 satisfying the following <<condition 2>> is formed between the outer circumferential surface of the thread groove pump stator 8 housed in the pump case C and the inner circumferential surface of the pump case C.

$$2d/D \leq \varepsilon_{max} \qquad \text{<<Condition 2>>}$$

D: Outer diameter of the stator component (the thread groove pump stator 8)

2d: Width of the gap G2

$\varepsilon_{max}$: Breaking elongation of the stator component (the thread groove pump stator 8) (see FIG. 3)

The rotor 4 of the vacuum pump P shown in FIG. 1 is supported by the magnetic bearing, as described above, and rotates at a high speed of 30,000 RPM. Therefore, large fracture energy is generated when the rotor 4 is damaged by coming into contact with a surrounding member.

However, according to the specific configuration of the spacers 9 or the thread groove pump stator 8 of the vacuum pump P shown in FIG. 1, the gap G1 or G2 satisfying the <<condition 1>> or <<condition 2>> described above is formed between the outer circumferential surface of each spacer 9 or of the thread groove pump stator 8 stored in the pump case C and the inner circumferential surface of the pump case C.

Therefore, according to the vacuum pump P shown in FIG. 1, even when each spacer 9 or the thread groove pump stator 8 is fully, extensionally deformed by the fracture energy, that is, even when each spacer 9 or the thread groove pump stator 8 is fully, extensionally deformed to approximately the same extent as the breaking elongation $\varepsilon_{max}$ thereof, the extensionally deformed spacer 9 or thread groove pump stator 8 does not come into contact with the inner surface of the pump case C or slightly comes into contact therewith. Consequently, the phenomenon where the fracture energy is transmitted to the pump case C through the extensionally deformed spacer 9 or thread groove pump stator 8 can be prevented effectively, enabling absorption of most of the fracture energy by the spacers 9 or thread groove pump stator 8.

According to the vacuum pump shown in FIG. 1 described above, because most of the fracture energy can be absorbed by the spacers 9 and thread groove pump stator 8, the following risks can be reduced: (1) the fracture energy damages the pump case C, causing vacuum break, (2) transmission of the fracture energy to the pump case C generates an abnormal torque in the pump case C, causing distortion of the pump case C, with the part on the gas inlet port 1A side being fixed, and (3) the fracture energy spreads to an apparatus outside the vacuum pump P, such as a process chamber or the like of a semiconductor manufacturing apparatus connected to the gas inlet port 1A of the vacuum pump P, resulting in damage of the apparatus. Therefore, the safety of the vacuum pump is improved.

Because the spacers 9 and thread groove pump stator 8 function as the means for absorbing the fracture energy by extensionally deforming themselves using the fracture energy, it is preferred that the spacers 9 and thread groove pump stator 8 be formed from a material with excellent elongation properties.

Figure 3:
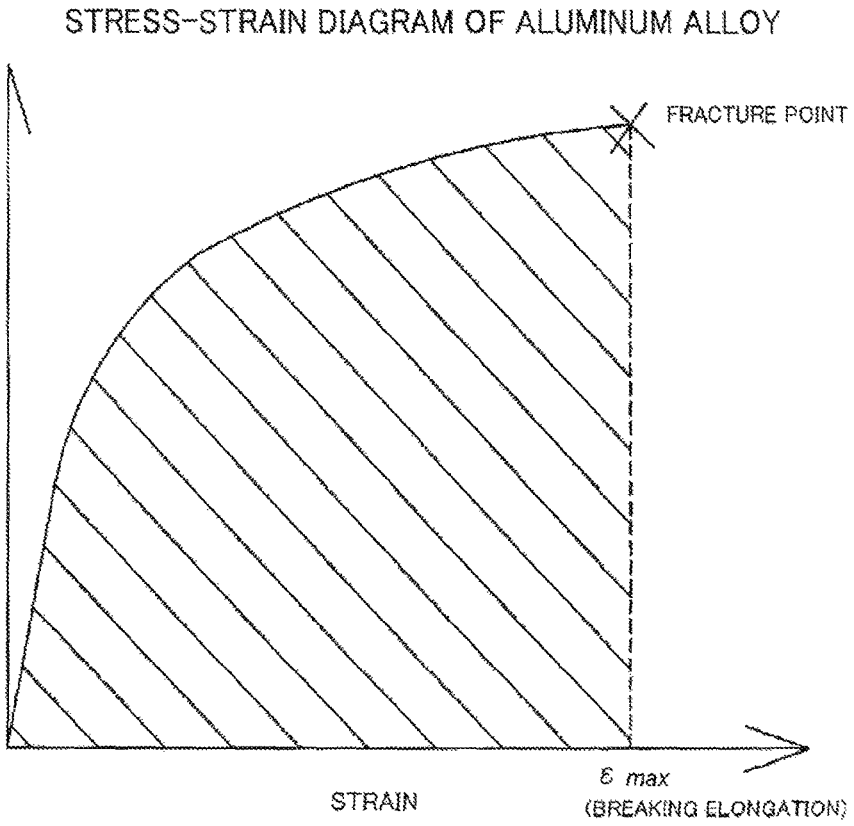
FIG. 3 is a stress-strain diagram of aluminum alloy.

FIG. 3 is a stress-strain diagram of aluminum alloy. The area with diagonal lines shown in this stress-strain diagram represents the amount of fracture energy (maximum value) that can be absorbed through deformation of the aluminum alloy. As can be understood from this stress-strain diagram, when a material with excellent elongation properties is used, the area with diagonal lines is large and the amount of fracture energy absorbed is high.

When comparing a solid material made of the same aluminum alloy with a casting made of the aluminum alloy, generally the solid material has better elongation properties. Therefore, according to the vacuum pump shown in FIG. 1, when the spacers 9 and thread groove pump stator 8 are made of aluminum ally, a solid material may be used to form these components.

Unfortunately, the cost of solid materials for the spacers 9 and thread groove pump stator 8 is high, leading to an increase in the cost of the entire vacuum pump P. Therefore, it is preferred that the spacers 9 and thread groove pump stator 8 be formed from a casting that is inexpensive and has approximately the same level of elongation properties as a solid material.

Examples of a casting that has approximately the same level of elongation properties as a solid material include a metal mold casting produced by casing with a metal mold, such as a metal mold casting made of Al—Mg-based aluminum alloy. Al—Mg-based aluminum alloy is suitable for use under vacuum and is therefore suitable as a constituent material for the spacers 9 and thread groove pump stator 8 of the vacuum pump shown in FIG. 1.

The metal mold casting described above means a casting produced by casting using a mold under gravity. This type of metal mold casting has a higher elongation percentage than a sand casting or a casting produced by die-casting, and has an elongation percentage that is close to that of a solid material. In order to further enhance the elongation properties of this type of metal mold casting, an additive such as strontium (Sr) may be added to the metal mold casting. The breaking elongation of the stator components such as the thread groove pump stator 8 and spacers 9 can be made equivalent to that of a solid material by adding the additive upon production of the stator components by means of casting.

Of all the sand castings, the one that is heated after being produced by casting with the mold (referred to as a "heated metal sand casting" hereinafter) sometimes produces a higher elongation percentage than a metal mold casting and an elongation percentage close to that of a solid material, depending on the heating process.

As described above, in the vacuum pump P shown in FIG. 1, the specific configurations of the spacers 9 and thread groove pump stator 8 employ a metal mold casting made of Al—Mg-based aluminum alloy that is produced by casting with a metal mold or a heated, sand mold.

The present invention is not limited to the foregoing embodiments, and various modifications can be made by anyone with conventional knowledge in this field within the technical scope of the present invention.

For instance, the present invention can be applied to a vacuum pump that is provided with neither the inlet-side gas passage R1 nor the outlet-side gas passage R2 of the gas passage R of the vacuum pump P shown in FIG. 1.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a cylindrical pump case;

a rotor provided rotatably inside the cylindrical pump case;

a plurality of spacers stacked in layers between the rotor and the cylindrical pump case;

a plurality of stator blades fixed to an inner circumferential surface of the cylindrical pump case with the plurality of spacers therebetween;

a plurality of rotary blades arranged on an outer circumferential surface of the rotor;

a gas passage configured with the plurality of stator blades and the plurality of rotary blades; and a gap formed between an outer circumferential surface of at least one of the plurality of spacers and the inner circumferential surface of the cylindrical pump case, wherein the gap satisfies the following condition:

$$2d/D \leq \varepsilon_{max}$$

wherein

D: Outer diameter of one of the plurality of spacers;

d: Width of the gap; and $\varepsilon_{max}$: Breaking elongation of one of the plurality of spacers.

2. The vacuum pump according to claim 1, at least one of the plurality of spacers are produced by a casting.

3. The vacuum pump according to claim 2, the at least one of the plurality of spacers are a metal mold casting produced by casting with a metal mold.

4. The vacuum pump according to claim 3, the at least one of the plurality of spacers are added with an additive when the at least one of the plurality of spacers are produced by the casting.

5. The vacuum pump according to claim 3, the at least one of the plurality of spacers are made of aluminum alloy.

6. The vacuum pump according to claim 2, the at least one of the plurality of spacers are a sand casting treated with heat processing after being produced by casting with a sand mold.

7. The vacuum pump according to claim 6, the at least one of the plurality of spacers are added with an additive when the at least one of the plurality of spacers are produced by the casting.

8. The vacuum pump according to claim 6, the at least one of the plurality of spacers are made of aluminum alloy.

9. The vacuum pump according to claim 2, the at least one of the plurality of spacers are added with an additive when the at least one of the plurality of spacers are produced by the casting.

10. The vacuum pump according to claim 9, the at least one of the plurality of spacers are made of aluminum alloy.

11. The vacuum pump according to claim 2, the at least one of the plurality of spacers are made of aluminum alloy.

12. The vacuum pump according to claim 1, at least one of the plurality of spacers are made of aluminum alloy.

* * * * *